US011131450B2

(12) United States Patent
Liu et al.

(10) Patent No.: US 11,131,450 B2
(45) Date of Patent: Sep. 28, 2021

(54) LIGHTING APPARATUS

(71) Applicant: XIAMEN ECO LIGHTING CO. LTD., Xiamen (CN)

(72) Inventors: Anyong Liu, Xiamen (CN); Yongzhe Dong, Xiamen (CN); Xiaoliang Wen, Xiamen (CN); Shouqiang Hou, Xiamen (CN); Ting Luo, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/816,243

(22) Filed: Mar. 11, 2020

(65) Prior Publication Data

US 2020/0348016 A1 Nov. 5, 2020

(30) Foreign Application Priority Data

Apr. 30, 2019 (CN) ..... 201920622956.3

(51) Int. Cl.

| | |
|---|---|
| ***F21V 29/77*** | (2015.01) |
| ***F21V 23/04*** | (2006.01) |
| ***F21S 8/04*** | (2006.01) |
| ***F21V 5/00*** | (2018.01) |
| ***F21V 14/06*** | (2006.01) |
| ***F21S 8/06*** | (2006.01) |
| ***F21V 29/83*** | (2015.01) |
| ***F21V 21/14*** | (2006.01) |
| ***F21Y 115/10*** | (2016.01) |

(52) U.S. Cl.

CPC ..... *F21V 29/777* (2015.01); *F21S 8/04* (2013.01); *F21S 8/06* (2013.01); *F21V 5/002* (2013.01); *F21V 14/06* (2013.01); *F21V 21/14* (2013.01); *F21V 23/0435* (2013.01); *F21V 23/0442* (2013.01); *F21V 29/83* (2015.01); *F21Y 2115/10* (2016.08)

(58) Field of Classification Search

CPC .... F21S 8/04; F21S 8/06; F21V 14/06; F21V 21/14; F21V 21/22; F21V 23/0435; F21V 23/0442; F21V 29/83; F21V 29/777

See application file for complete search history.

(56) References Cited

U.S. PATENT DOCUMENTS

| | | | | |
|---|---|---|---|---|
| 7,611,264 | B1 * | 11/2009 | Chang | F21K 9/00 362/249.02 |
| 9,622,314 | B1 * | 4/2017 | Li | F21V 23/008 |
| 2012/0176792 | A1 * | 7/2012 | Stolte | F21V 29/83 362/243 |

(Continued)

*Primary Examiner* — William N Harris

(74) *Attorney, Agent, or Firm* — Chun-Ming Shih; Lanway IPR Services

(57) ABSTRACT

A lighting apparatus includes a housing. The housing have a first portion and a second portion. The first portion has a first curving angle, and the second portion has a second curving angle. The first curving angle has a larger diameter than the second curving angle. A light passing cover has a main section and a frame section. The main section has more light passing than the frame section. The frame section is connected to the housing. A light source assemblage is for emitting light through the light passing cover. A driving module is for transmitting a driving current to the light source assemblage for emitting light. A wing structure is attached to a side edge of the housing, and the wing structure has a heat dissipation device for passing a heat out of the housing.

17 Claims, 11 Drawing Sheets

(56) References Cited

U.S. PATENT DOCUMENTS

| | | | | |
|---|---|---|---|---|
| 2012/0262921 | A1* | 10/2012 | Boomgaarden | F21V 21/047 362/249.02 |
| 2014/0049939 | A1* | 2/2014 | Kuenzler | F21S 8/04 362/84 |
| 2016/0061396 | A1* | 3/2016 | Bosua | G08C 23/04 362/231 |
| 2017/0163439 | A1* | 6/2017 | Bosua | H04B 10/1149 |
| 2019/0162373 | A1* | 5/2019 | Portinga | F21V 5/045 |

* cited by examiner

LIGHTING APPARATUS

FIELD

The present invention is related to an apparatus and more particularly related to a lighting fixture.

BACKGROUND

For many years the lighting of interiors of vehicles, aircraft, buildings, and watercraft, and more recently the lighting of exteriors of vehicles have used the cold cathode lamp; more commonly known as the fluorescent lamp or a fluorescent system. The fluorescent lamp however has limitations on its capabilities and usages. The fluorescent lamp has disadvantages to the consumer. The disadvantages of the fluorescent lamp are the short life, easily broken, low durability, high costs of replacement, high costs of specialty lights, limited color selection, electromagnetic interference which may be harmful to other electronic equipment. The manufacturing of fluorescent lamps and debris from replaced lamps have a high environmental risk, as the chemicals inside of a fluorescent lamp are toxic. Also, the flicker effect of dying or improperly installed fluorescent lamps may be extremely harmful to individuals with certain medical conditions. The constant inconsistency of fluorescent lighting colors is often a complaint of consumers who have to replace lamps on a regular basis. A fluorescent system cannot be used effectively in extreme low or high ambient temperatures.

Lighting includes the use of both artificial light sources like lamps and light fixtures, as well as natural illumination by capturing daylight. Daylighting such as using windows, skylights, or light shelves, is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants. Indoor lighting is usually accomplished using light fixtures and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

A lighting apparatus includes a housing, a light passing cover, a light source assemblage, a driving module and a wing structure. The housing has a first portion and a second portion. The first portion has a first curving angle, and the second portion has a second curving angle. The first curving angle has a larger diameter than the second curving angle. The light passing cover has a main section and a frame section, the main section has more light passing than the frame section. The frame section is connected to the housing. The light source assemblage is for emitting light through the light passing cover. The driving module is for transmitting a driving current to the light source assemblage for emitting light. The wing structure is attached to a side edge of the housing, and the wing structure has a heat dissipation device for passing a heat out of the housing.

In some embodiments, the heat dissipation device has a front portion and a back portion. The front portion has an extending structure. The extending structure is for supporting the lighting apparatus. The back portion has a plurality of holes for increasing the heat dissipation.

In some embodiments, the heat dissipation device has a wave structure for enlarging an area to conduct the heat passing out of the housing.

In some embodiments, the lighting apparatus also includes a base column. The base column is a detachable device connected to a surface, and the base column is connected to the housing for setting a distance between the surface and the housing as a heat protection structure.

In some embodiments, the base column has a bendable strip. The bendable strip is connected to the base column and the housing for changing a lighting area of the lighting apparatus.

In some embodiments, the bendable strip is a plurality of segments. The plurality of segments is being connected together. An expendable portion is between each of the segments for the bendable strip to expend for adjusting a distance between the lighting apparatus and the lighting area.

In some embodiments, the light passing cover has a sliding track connected to the housing, and the sliding track provides the light passing cover to rotate for changing an irradiation pattern.

In some embodiments, the irradiation pattern has a first lighting mode and a second lighting mode. The first lighting mode has a beaming lens structure for condensing a lighting area, and the second lighting mode has a radiative lens structure for enlarging a beam angle.

In some embodiments, the lighting apparatus also includes a connecting structure. The connecting structure combines the housing and the light passing cover.

In some embodiments, the connecting structure has a first end and a second end. The first end has a protrusion portion. The protrusion portion is connected to a holding portion of the housing. The second end has an opening notch. The open notch connected to a head.

In some embodiments, the driving module has a wireless communicating device. The wireless communicating device receives a signal from a command. The command is given from an external remote device. The wireless communicating device then conducts the signal to an external output system. The external output system revises the signal to an indicated sign and send the indicated sign back to the wireless communicating device, and the wireless communicating device sends the indicated sign to command the lighting apparatus corresponding to the external remote device.

In some embodiments, the external remote device has a determined group with multiple applications, and the multiple applications provides functional services of the lighting apparatus.

In some embodiments, the driving module has a memorizing device for a determined action command of a user. The memorizing device may memorize an action pattern of the user, or the user may determine the action pattern themselves.

In some embodiments, the memorizing device has a tracking system tracking a light emitting period of an area through a sensor for changing an illumination of the lighting apparatus.

In an embodiment, the memorizing device has a sound transmitting system receiving a voice from the user. The sound transmitting system senses an emotion in the voice and gives an instruction to the lighting apparatus according to the emotion.

In some embodiments, the light source assemblage has a first set and a second set. The first set has a first color temperature light source and a second set has a second color temperature light source. The first set and the second set share a common driving current. The first set has a first segment and a second segment. The second set also has a first segment and a second segment. The common driving current is passed to the first set and the second set in a plurality of time slots. At least one of the first segment and the second segment of the first set and at least one of the first segment and the second segment of the second set emits the light in every time slot.

In some embodiments, the light source assemblage has an inner roll system and an outside roll system. The inner roll system emits light to a partial area and the outside roll system emits light to an external area.

In some embodiments, the housing has a light passing hive system for a light to diffuse along an installed surface. The light passing hive system has a plurality of notches for the light to pass out.

In some embodiments, the light passing hive system has an inner portion and a side portion. The inner portion contains a corner for the light to spread out and the side portion has a reflective optic to transmit the light to an extensive angle.

In some embodiments, the light passing hive system has an extendable cover shield for covering the light to diffuse along the installed surface. The extendable cover shield has a first terminal and a second terminal. The first terminal has a top portion and a bottom portion, and the second terminal has a top portion and a bottom portion. The top portion of the first terminal is connected to the bottom portion of the second terminal, and the bottom portion of the first terminal is connected to the top portion of the second terminal. The first terminal and the second terminal is connected between the housing and the light passing hive system.

DETAILED DESCRIPTION

Reference may now be made in detail to particular embodiments of the disclosure, examples of which are illustrated in the accompanying drawings. While the disclosure may be described in conjunction with the preferred embodiments, it may be understood that they may not intended to the limit the disclosure to these embodiments. On the contrary, the invention is intended to cover alternatives, modifications and equivalents that may be included within the spirit and scope of the disclosure as defined by the appended claims. Furthermore, in the following detailed description of the present disclosure, numerous specific details are set forth in order provide a thorough understanding of the present disclosure. However, it may be readily apparent to one skilled in the art that the present disclosure may be practiced without these specific details. In other instances, well-known methods, procedures, processes, components, structures, and circuits have not been described in detail so as not to unnecessarily obscure aspects of the present invention.

Figure 10:
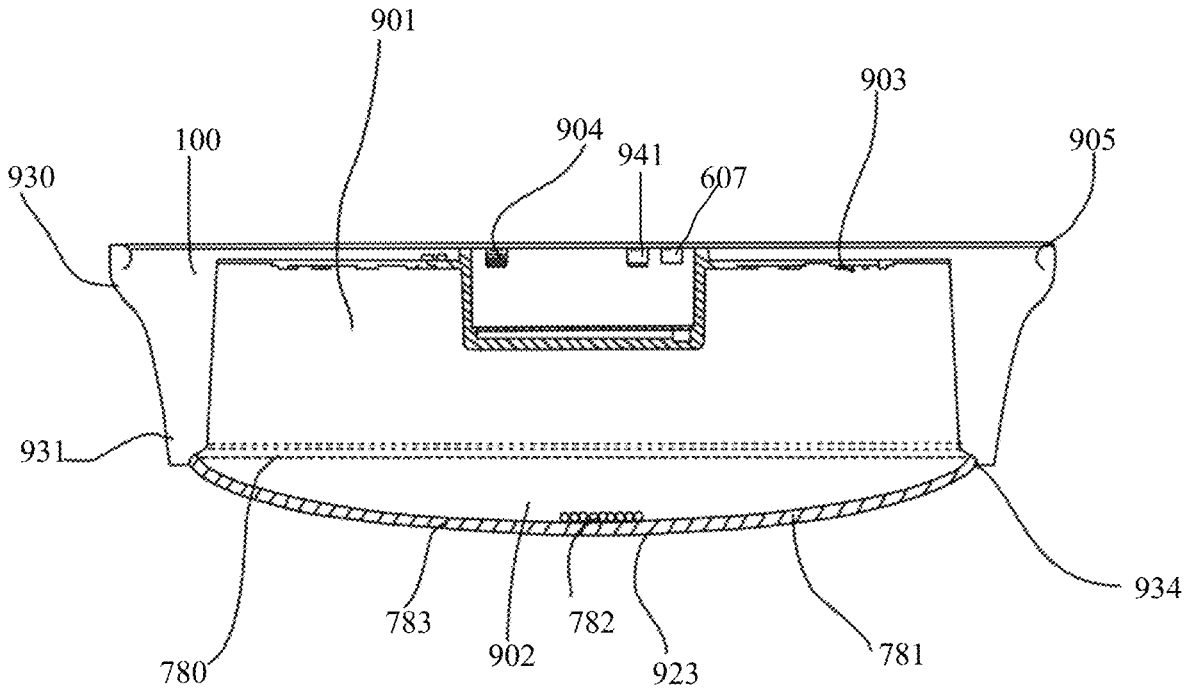
FIG. 10 is side perspective view of an embodiment of a lighting apparatus.
Figure 11:
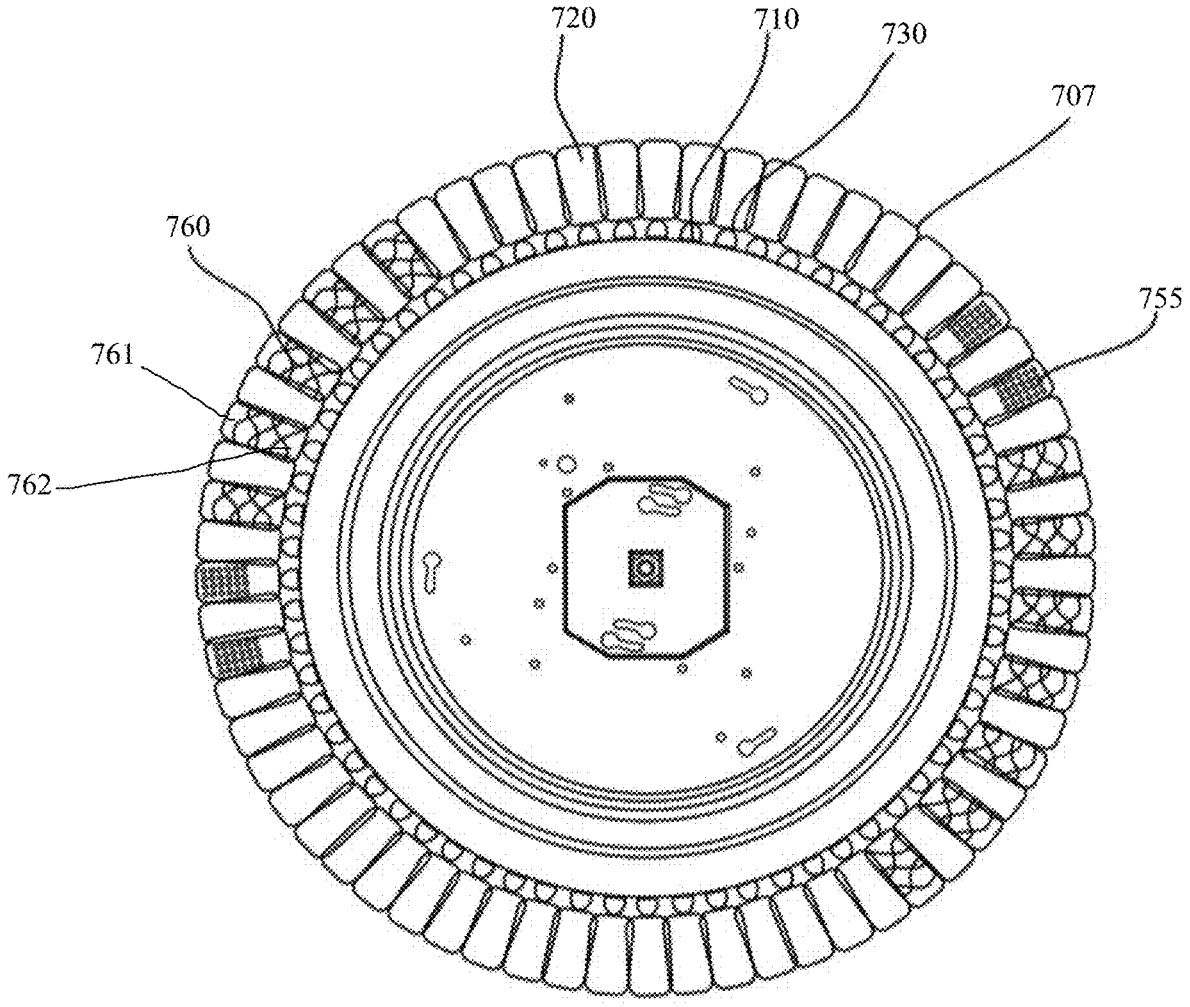
FIG. 11 is a top view of an embodiment of a heat dissipation device.

Please refer to FIG. 10 and FIG. 11, a lighting apparatus 100 includes a housing 901, a light passing cover 902, a light source assemblage 903, a driving module 904 and a wing structure 905. The housing 901 has a first portion 930 and a second portion 931. The first portion 930 has a first curving angle, and the second portion 931 has a second curving angle. The first curving angle has a larger diameter than the second curving angle. The light passing cover 902 has a main section 923 and a frame section 924, and the main section 923 has more light passing than the frame section 924. The frame section 924 is connected to the housing 901. The light source assemblage 903 is for emitting light through the light passing cover 902. The driving module 904 is for transmitting a driving current to the light source assemblage 903 for emitting light. The wing structure 905 is attached to a side edge of the housing 901, and the wing structure 905 has a heat dissipation device 707 for passing a heat out of the housing 901.

Please refer to FIG. 11, the heat dissipation device 707 has a front portion 710 and a back portion 720. The front portion 710 has an extending structure 730. The extending structure 730 is for supporting the lighting apparatus. The back portion 720 has a plurality of holes 755 for increasing the heat dissipation. For example, when a hole has been dug on a surface for installation, the front portion 710 may fit in every size of the holes to cover and to support the lighting apparatus to be fixed properly on the surface for installation.

In some embodiments, the heat dissipation device 707 has a wave structure 760 for enlarging an area to conduct the heat passing out of the housing 901. The wave structure 760 may be on the surface of the heat dissipation device 707 such as a plurality of protrusions and hollows making an uneven surface to increase the area of the heat dissipation device 707 for increasing the efficiency of the heat dissipation. The heat dissipation device 707 may also be a wave in another embodiment. The wave structure 760 has a higher portion 761 and a lower portion 762 to make the heat has a larger area to be passed out and also be flexible in with the heat and the cold.

Figure 15:
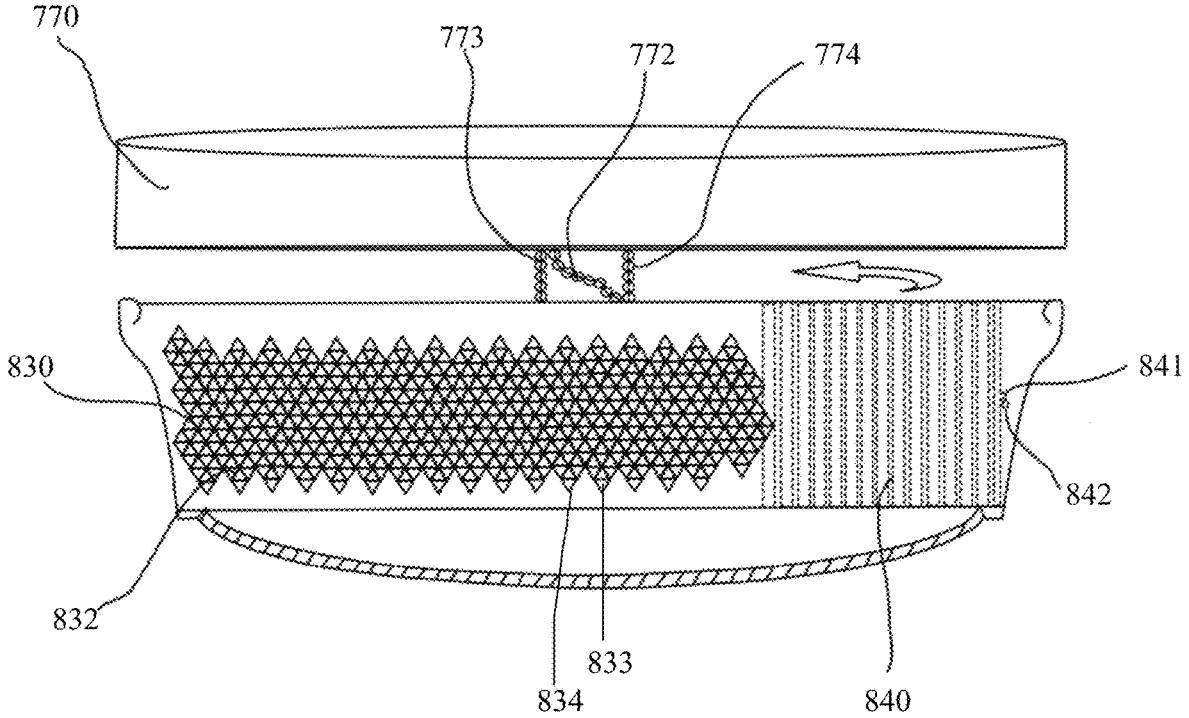
FIG. 15 is a schematic side view of a lighting apparatus.

Please refer to FIG. 10 and FIG. 15, in some embodiments, the lighting apparatus also includes a base column 770. The base column 770 is a detachable device connected to a surface, and the base column 770 is connected to the housing 901 or setting a distance between the surface and the housing 901 as a heat protection structure. The base column 770 may also cover the hole on an installation surface.

In some embodiments, the base column 770 has a bendable strip 772. The bendable strip 772 is connected to the base column 770 and the housing 901 for changing a lighting area of the lighting apparatus 100. In some embodiments, the bendable strip 772 is a plurality of segments 773. The plurality of segments 773 is being connected together. An expendable portion 774 is between each of the segments 773 for the bendable strip 772 to expend for adjusting a distance between the lighting apparatus 100 and the lighting area.

In some embodiments, the light passing cover has a sliding track 780 connected to the housing 901, and the sliding track 780 provides the light passing cover to rotate for changing an irradiation pattern 781.

In some embodiments, the irradiation pattern has a first lighting mode 782 and a second lighting mode 783. The first lighting mode 782 has a beaming lens structure for condensing a lighting area, and the second lighting mode 783 has a radiative lens structure for enlarging a beam angle.

Figure 12:
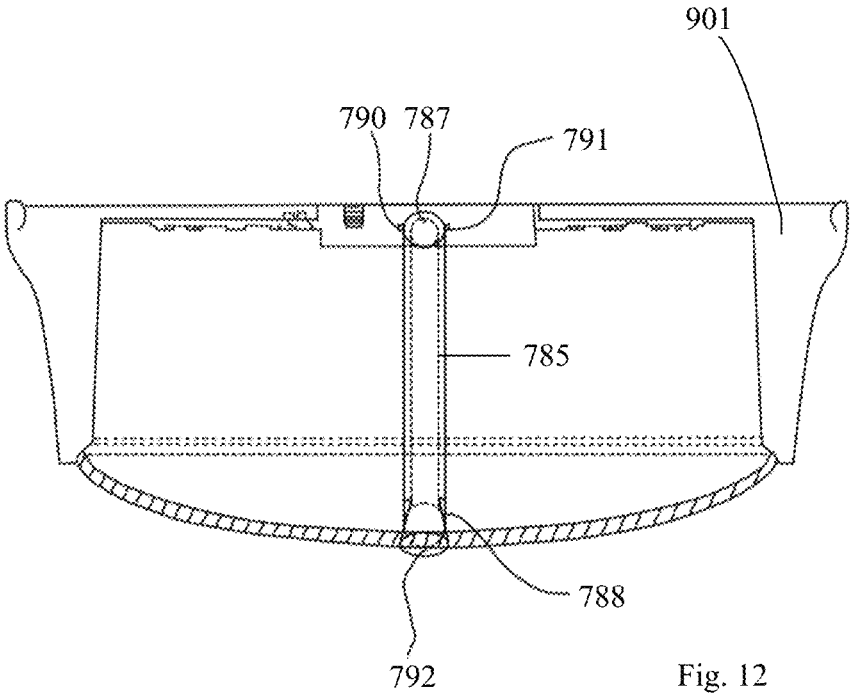
FIG. 12 is a side view of an embodiment of a connecting structure.

Please refer to FIG. 12, in some embodiments, the lighting apparatus also includes a connecting structure 785. The connecting structure 785 combines the housing 901 and the light passing cover. For example, the connecting structure 785 may be a vertical column basing in the middle of the lighting apparatus connecting the housing and the light passing tube. The distance to a center of the lighting apparatus may be the same or similar, and the vertical column may support the lighting apparatus with less material and spend less space for a supporting structure.

In some embodiments, the connecting structure 785 has a first end 787 and a second end 788. The first end 787 has a protrusion portion 789. The protrusion portion 789 is connected to a holding portion 790 of the housing 901. The second end has an open notch 791. The open notch 791 connected to a head 792.

Figure 13:
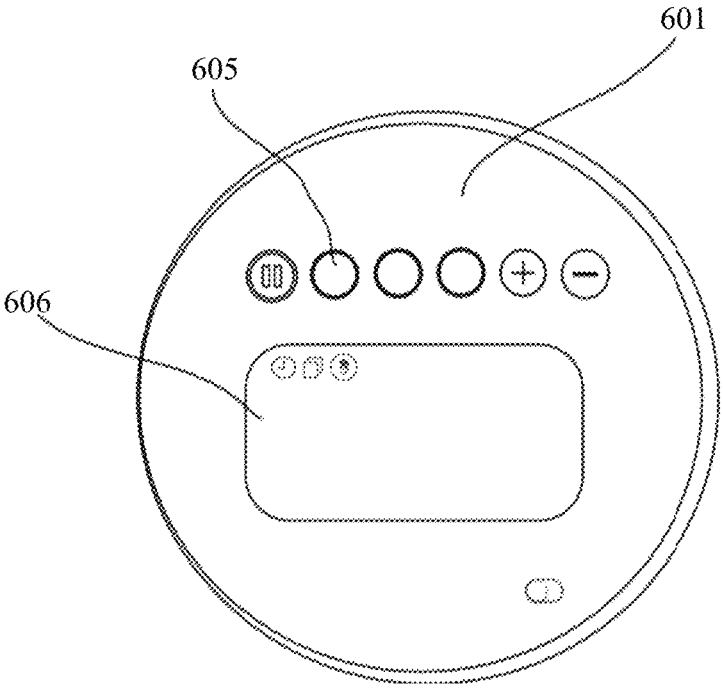
FIG. 13 is a schematic view of an embodiment of an external remote device.

Please refer to FIG. 10 and FIG. 13, in some embodiments, the driving module has a wireless communicating device 941. The wireless communicating device 941 receives a signal from a command. The command is given from an external remote device 601. The wireless communicating device 941 then conducts the signal to an external output system. The external output system revises the signal to an indicated sign and send the indicated sign back to the wireless communicating device 941, and the wireless communicating device 941 sends the indicated sign to command the lighting apparatus corresponding to the external remote device 601.

In some embodiments, the external remote device 601 has a determined group 605 with multiple applications 606, and the multiple applications 606 provides functional services of the lighting apparatus.

In some embodiments, the driving module has a memorizing device 607 for a determined action command of a user.

In some embodiments, the memorizing device 607 has a tracking system tracking a light emitting period of an area through a sensor for changing an illumination of the lighting apparatus.

In an embodiment, the memorizing device 607 has a sound transmitting system receiving a voice from the user. The sound transmitting system senses an emotion in the voice and gives an instruction to the lighting apparatus according to the emotion.

Figure 14:
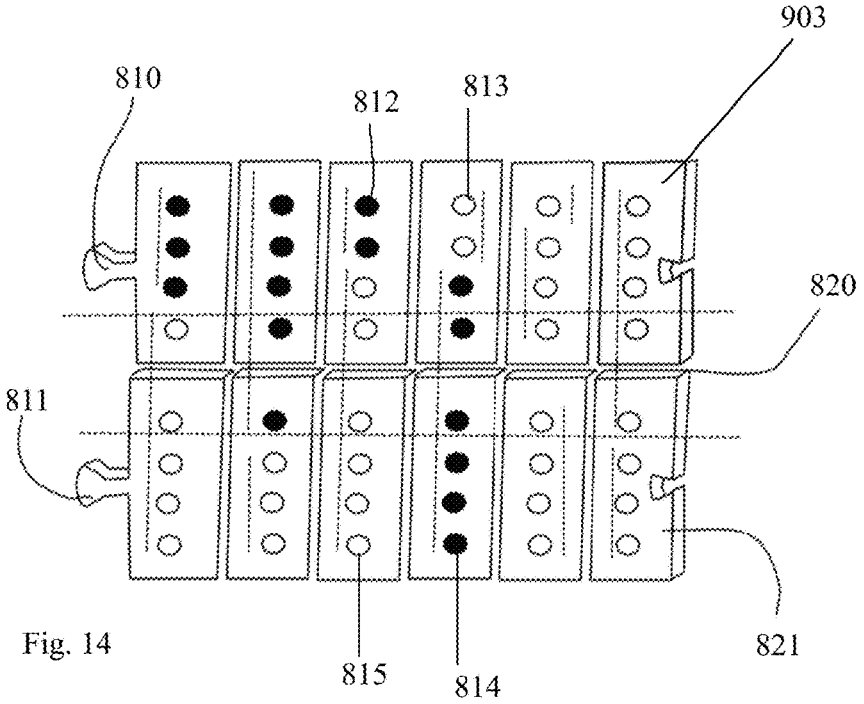
FIG. 14 is a schematic view of an embodiment of a light source assemblage.

Please refer to FIG. 14, the light source assemblage 903 has a first set 810 and a second set 811. The first set 810 has a first color temperature light source and a second set 811 has a second color temperature light source. The first set 810 and the second set share a common driving current. The first set 810 has a first segment 812 and a second segment 813. The second set 811 also has a first segment 814 and a second segment 815. The common driving current is passed to the first set 810 and the second set 811 in a plurality of time slots. At least one of the first segment 812 and the second segment 813 of the first set 810 and at least one of the first segment 814 and the second segment 815 of the second set 811 emits the light in every time slot.

In some embodiments, the light source assemblage has an inner roll system 820 and an outside roll system 821. The inner roll system 820 emits light to a partial area and the outside roll system 821 emits light to an external area.

Please refer to FIG. 15, the housing has a light passing hive system 830 for a light to diffuse along an installed surface. The light passing hive system 830 has a plurality of notches 832 for the light to pass out. In an embodiment, the plurality of notches 832 is composed in different shapes. For example, the notches 832 near a top is larger than the notches 832 near the bottom, the notches 832 near the bottom is larger than the notches 832 near the top, the notches 832 near the top and the bottom is larger than the notches 832 in the middle, or the notches 832 near the top and the bottom is smaller than the notches 832 near in the middle. A different size of the notches 832 of the light passing hive system 830 may have corresponding a different micro air flow that influence the pattern of conducting the heat and also the passing of the light.

In some embodiments, the light passing hive system 830 has an inner portion 833 and a side portion 834. The inner portion 833 contains a corner for the light to spread out and the side portion 834 has a reflective optic to transmit the light to an extensive angle.

In some embodiments, the light passing hive system 830 has an extendable cover shield 840 for covering the light to diffuse along the installed surface. The extendable cover shield 840 has a first terminal 841 and a second terminal 842. The first terminal 841 has a top portion and a bottom portion, and the second terminal 842 has a top portion and a bottom portion. The top portion of the first terminal 841 is connected to the bottom portion of the second terminal 842, and the bottom portion of the first terminal 841 is connected to the top portion of the second terminal 842. The first terminal 841 and the second terminal 842 is connected between the housing and the light passing hive system 830.

Please refer to FIG. 1 to FIG. 4, in an embodiment, a lighting apparatus 100 includes a surface ring 10, a light passing cover 20, a light source assemblage 30, and a driving module 40 connected to the light source assemblage 30 for driving the light source assemblage 30. The surface ring 10 includes a substrate plate 11 and a surface ring main body 12 extends a whole body from an edge peripheral of the substrate plate 11, and the surface ring main body 12 is fixed to the external edge of the substrate plate 11 that may enlarge a heat dissipation area to increase the efficiency of a heat dissipation, and fit in the light source assemblage 30 with different power output. The surface ring 10 processed in an integrated way may reduce the elements, simplified the assembly, and cost down the cost. In addition, the surface ring 10 and the light passing cover 20 composed together to be the surface appearance of the lighting apparatus that have been more decorative. The surface ring 10 may directly installed to the ceiling that reduce the elements to cost down the cost and make the process more convenient. The substrate plate 11 has an installation sink 114. The light source assemblage 30 and the driving module 40 is installed in the installation sink respectively. The light passing cover 20 is installed on the substrate plate 11 and seals the installation sink 114.

In an embodiment, the lighting apparatus, comparing to the technology now, the surface ring 10 includes a substrate plate 11 and a surface ring main body 12 extends a whole body from an edge peripheral of the substrate plate 11, and the surface ring main body 12 is fixed to the external edge of the substrate plate 11 that may enlarge a heat dissipation area to increase the efficiency of a heat dissipation, and fit in the light source assemblage 30 with different power output. The surface ring 10 processed in an integrated way may reduce the elements, simplified the assembly, and cost down the cost.

Figure 1:
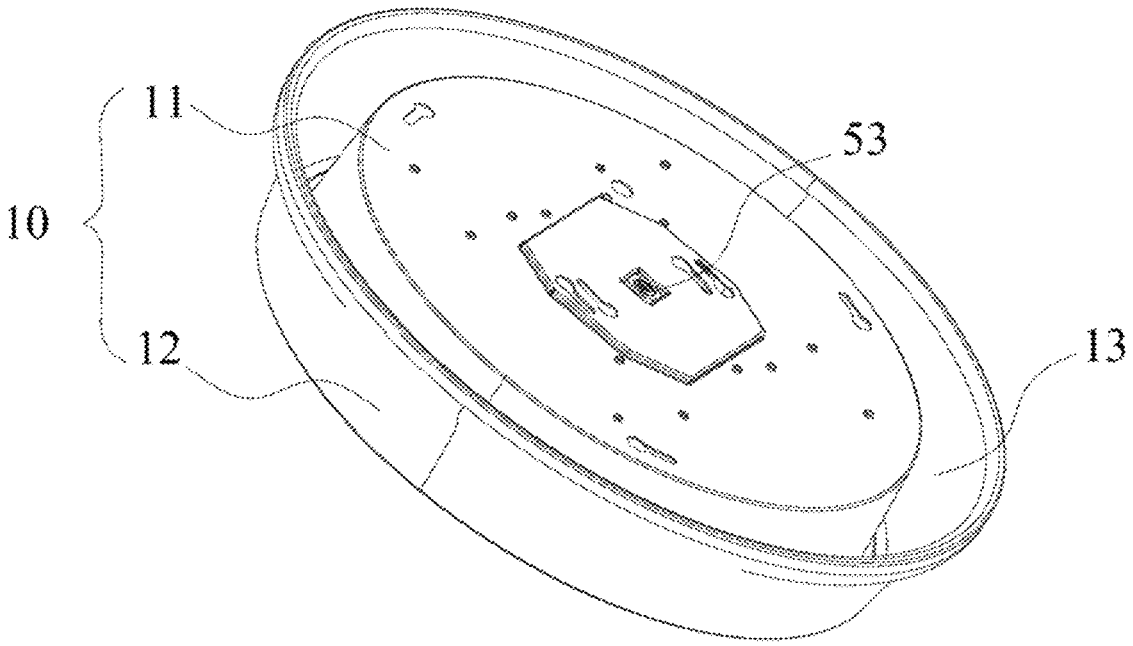
FIG. 1 illustrates an embodiment of a lighting apparatus.
Figure 2:
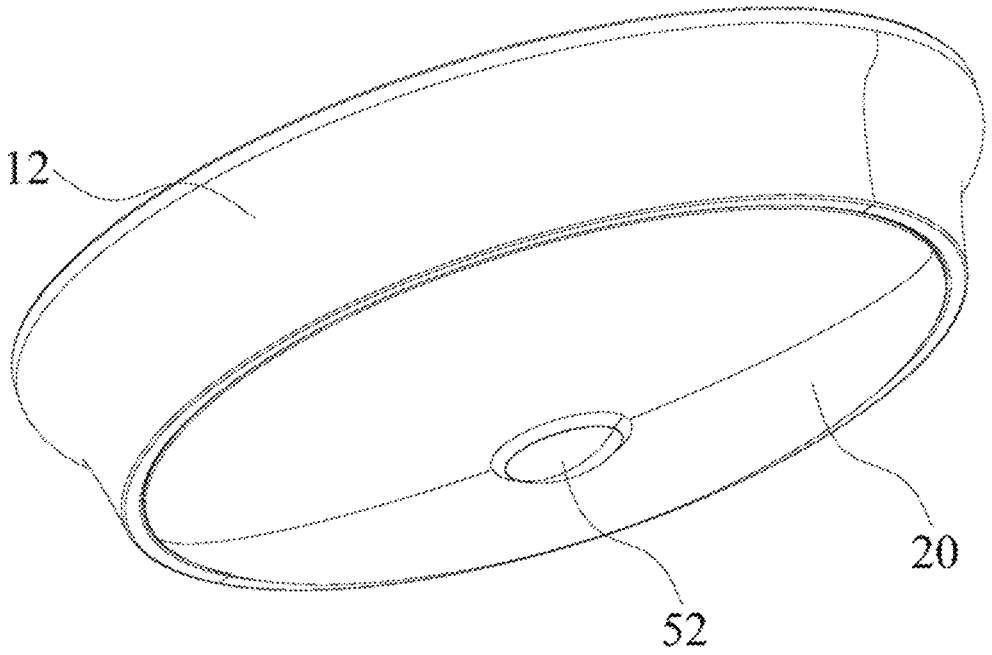
FIG. 2 is a front side view of an embodiment of a lighting apparatus.
Figure 3:
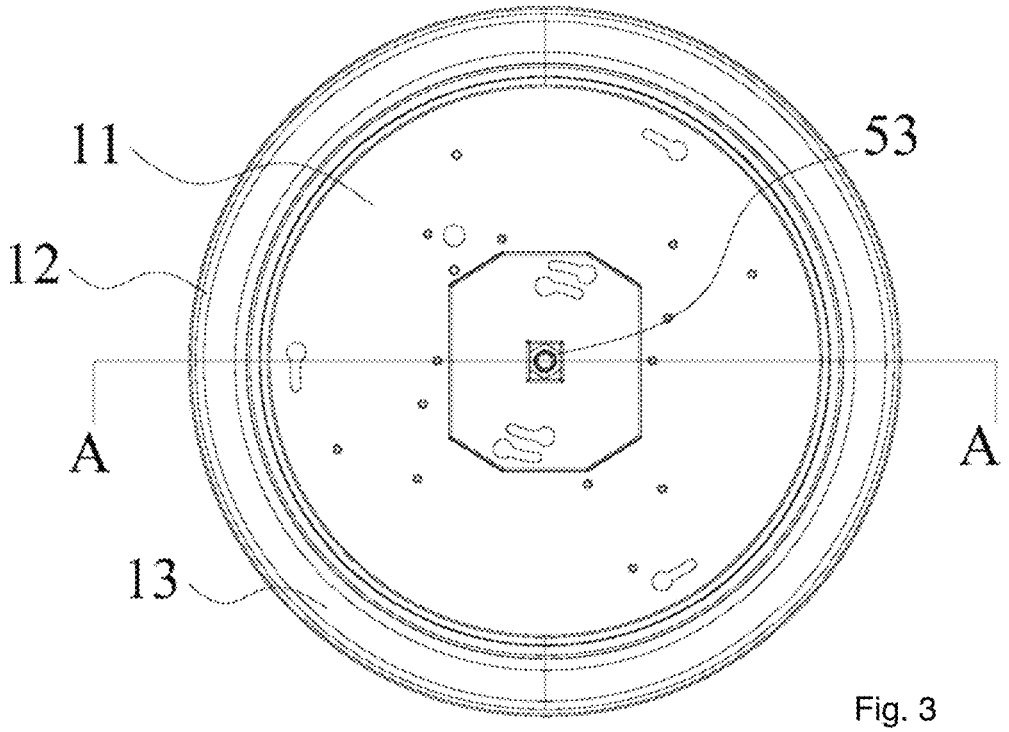
FIG. 3 is a top view of an embodiment of a lighting apparatus.
Figure 4:
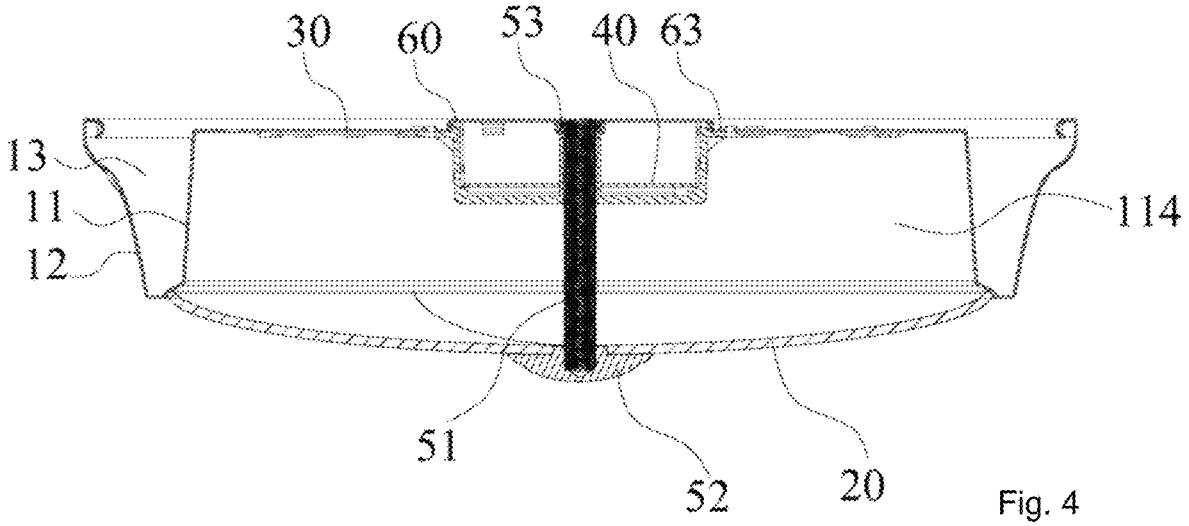
FIG. 4 is a perspective side view of an embodiment of a lighting apparatus.
Figure 5:
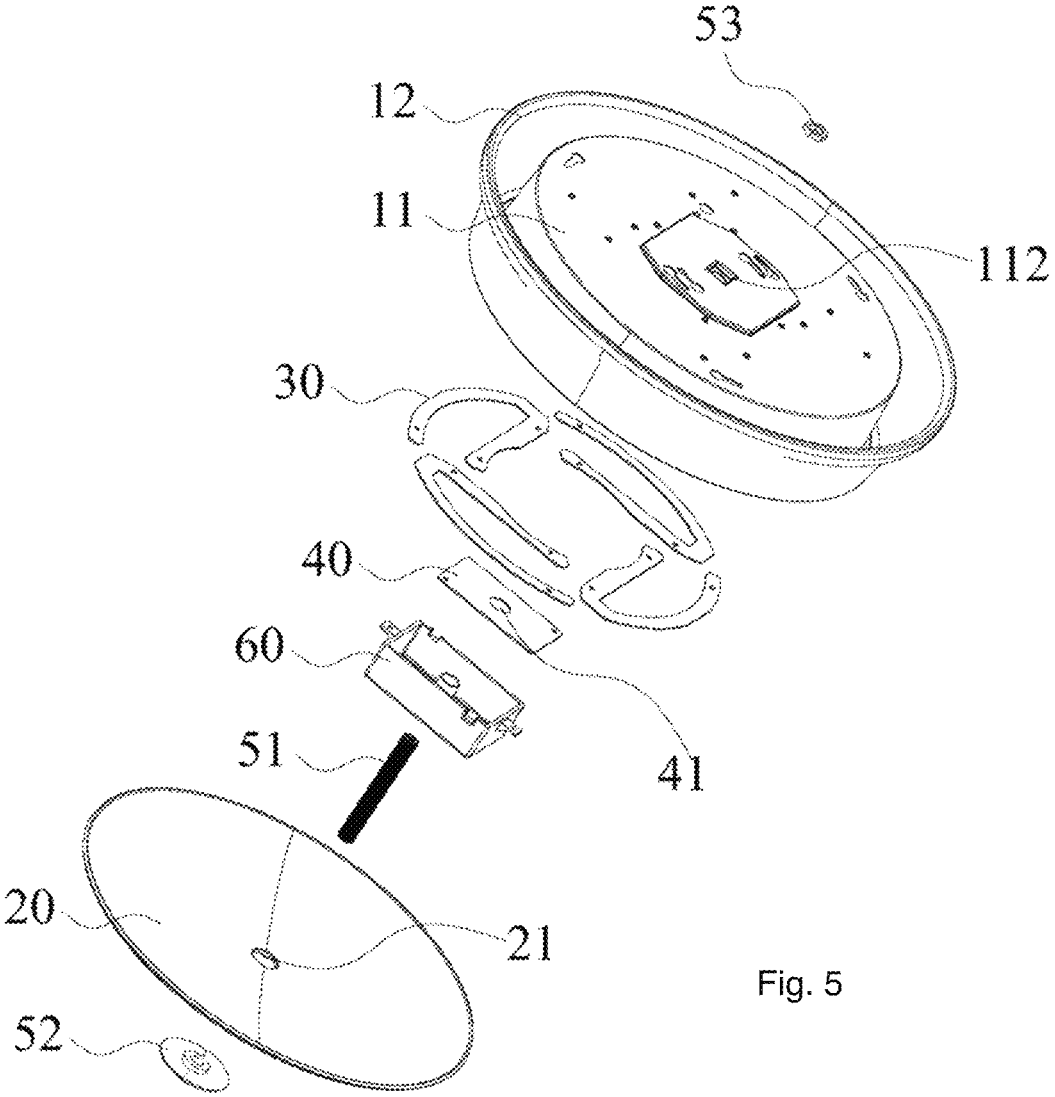
FIG. 5 is an exploded view of an embodiment of a lighting apparatus.

Please refer to FIG. 4 and FIG. 5, the lighting apparatus may also be used to detach the light passing cover 20 to install to a first fasten module of the substrate plate 11. The first fasten module includes a first connecting piece 51 and a first setting piece 52. The light passing cover 20 has a first path hole 21, and the first connecting piece 51 is fixed to the substrate plate 11. An end of the first connecting piece 51 reached outside the first path hole 21 is connected to the first setting piece 52 for the installation of the light passing cover 20. When the light passing cover 20 needs to be detached, a user may disconnect the first setting piece 52 and the first connecting piece 51 for disconnecting the light passing cover 20 and the substrate plate 11 that makes the installation more convenient and improve the efficiency of working.

Please refer to FIG. 4 and FIG. 5, in an embodiment of a lighting apparatus, a first connecting piece 51 as a screw column, a first setting piece 52 as a decoration nut. An end of the decoration nut reaches into a first path hole 21 and is screw connected to a screw column. Through the cooperation of the screw column and the decoration nut to provide a detachment and installation of a light passing cover 20 in a more convenient and avoid the inconvenience of the installation of rotating in and out the light passing cover 20, and the first setting piece 52 is the decoration nut with a better appearance.

Please refer to FIG. 4 to FIG. 5, the first fasten module also includes fixing the screw column which is detachable to a first nut 53 on the substrate plate 11. The substrate plate 11 has a second screw column 111, and another end of the screw column passed through the second path hole 111 is screw connected to the first nut 53 for the installation between the screw column and the substrate plate 11. When the screw column needs to be detached, it is more convenient to just detached the first nut 53 and the screw column.

Figure 6:
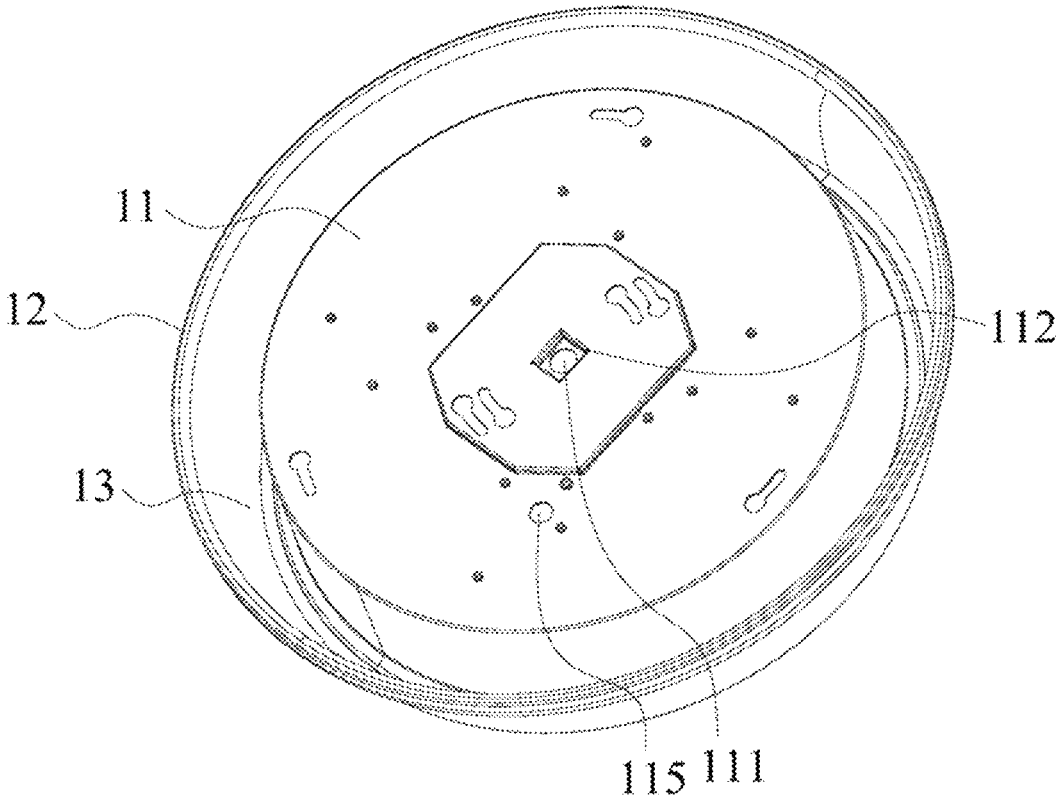
FIG. 6 is top view of an embodiment of a lighting apparatus.

Please refer to FIG. 4 and FIG. 6, the substrate plate 11 departed from an edging surface of the light passing cover 20 has a concave cavity 112 for containing the first nut 53, furthermore, a depth of the concave cavity is larger than or equal to a height of the first nut 53 for avoiding the first nut protruded out of the substrate plate 11.

Figure 7:
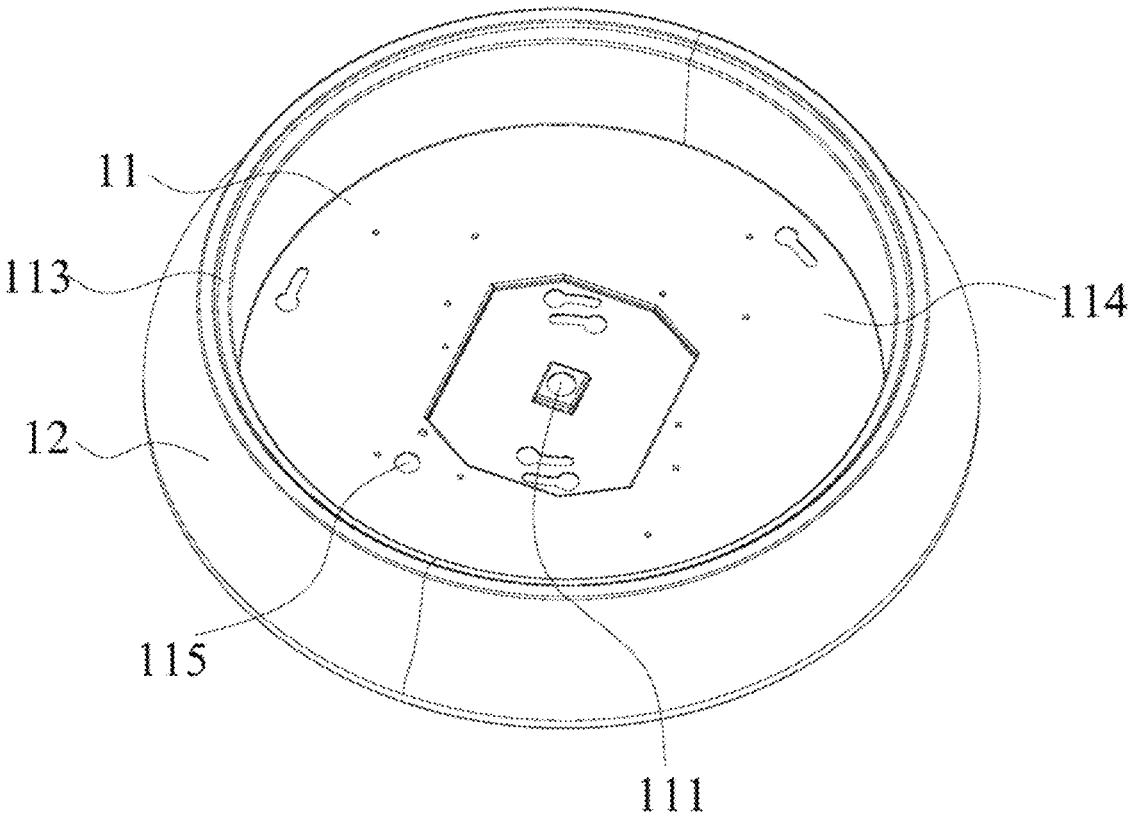
FIG. 7 is a top view of an embodiment of a lighting apparatus.

Please refer to FIG. 6 and FIG. 7, in an embodiment of the lighting apparatus, between the surface ring main body 12 and a side wall of the substrate plate 11 has a gap 13. The gap 13 gradually increases along an opposite direction of the light passing cover 20 for hastening the heat dissipation. Among them, the surface ring main body is made of a metal material all in one piece for increase the efficiency of the heat dissipation. The external side of the surface ring main body may be paste into different colors to be more decorative.

In an embodiment of the lighting apparatus, the driving module 40 includes a moving terminal for wireless communicating connected to a communication module to provide a more intelligent and convenient to control and turn-on, turn-off and an illumination of the lighting apparatus from a distance which avoid the traditional way of using hand turning on and off the light. The communication module may be a Bluetooth module or a WIFI module . . . etc.

Please refer to FIG. 4, a top edge of the substrate plate 11 has a ladder 113, and the light passing cover is fixed to the ladder for a position limitation.

Please refer to FIG. 4 and FIG. 5, the lighting apparatus also includes a driver box 60. A driving module 40 is fixed inside the driver box 60, and the driver box 60 may be detachably installed to the substrate plate 11. The driving module may be installed steadily through by having the driver box 60.

Figure 8:
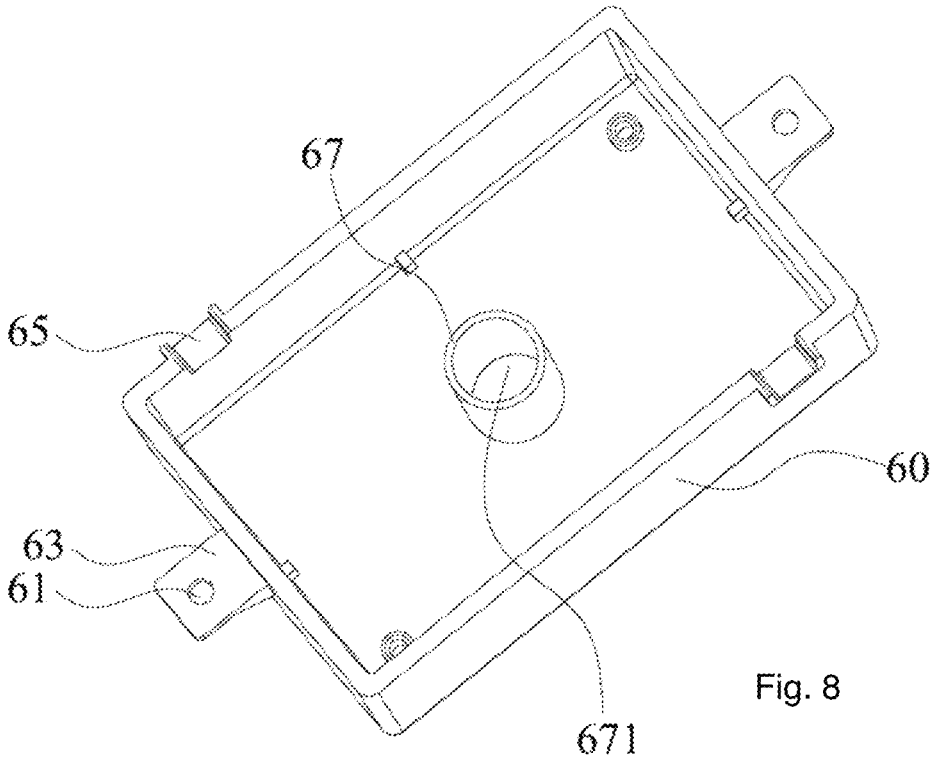
FIG. 8 is a schematic bottom view of an embodiment of a driver box.

Please refer to FIG. 7 to FIG. 8. As a specific application of the lighting apparatus in an embodiment, the lighting apparatus also includes the second fastener module, which is used to detachably install the driver box 60 on the substrate plate 11. The second fastener module includes the second connecting piece and the second setting piece. The third path hole 61 is installed on the driver box 60 and the fourth path hole 115 is installed on the substrate plate 11. One end of the second connecting piece passes through the third path hole 61 and the fourth path hole 115 one by one and is connected and fixed on the second setting piece, to implement the installation of the driver box 60.

Figure 9:
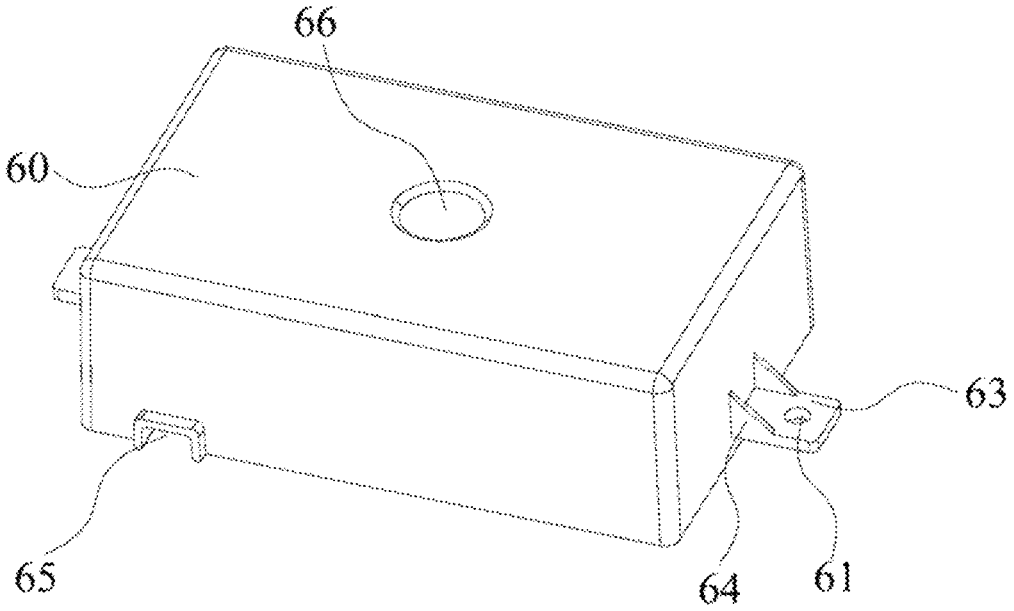
FIG. 9 is a schematic top view of an embodiment of a driver box.

Please refer to FIG. 8 to FIG. 9. As a specific application of the lighting apparatus in an embodiment, the connecting board 63 is installed on the side wall of the driver box 60, and the third path hole 61 is installed on the connecting board 63. The reinforce band 64 is installed between the connecting board 63 and the driver box 60, to strengthen the structural intensity of the connecting board 63. The wire passing hole 65 is also installed on the side wall of the driver box 60, to let the connecting line pass through.

Please refer to FIG. 4 to FIG. 5 and FIG. 8 to FIG. 9. As a specific application of the lighting apparatus in an embodiment, the fifth path hole 66 is installed on the driver box 60 and the sixth path hole 41 is installed on the driving module 40. One end of the screw column passes through the sixth path hole 41, the fifth path hole 66 and the first path hole 21 in order and reaches out of the light passing cover 20. It may play the role of avoiding, make the entire structure become more compact and decrease its volume effectively by installing the fifth path hole 66 on the driver box 60 and installing the sixth path hole 41 on the driving module 40. The guiding column 67 is installed in the driver box 60, and the seventh path hole 671, which is connected to the fifth path hole 66 and is used to let the screw pass through, is installed on the guiding column 67. It may play the role of position limitation and avoid the situation of displacement of the screw, by installing the guiding column 67.

Please refer to FIG. 4 and FIG. 5, in an embodiment of the lighting apparatus, the light source assemblage 30 may have multiple sets. The multiple sets of the light source assemblage 30 evenly surrounded the driver box 60 that makes the illumination of the light passing out evenly. The light source assembly 30 may be steady fixed to the substrate plate 11 for the convenience of installation.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a housing having a first portion and a second portion, the first portion having a first curving angle, the second portion having a second curving angle, the first curving angle having a larger diameter than the second curving angle;

a light passing cover having a main section and a frame section, the main section having more light passing than the frame section, the frame section being connected to the housing;

a light source assemblage for emitting light through the light passing cover;

a driving module transmitting a driving current to the light source assemblage for emitting light; and a wing structure attached to a side edge of the housing;

wherein the wing structure have a heat dissipation device for passing a heat out of the housing.

2. The lighting apparatus of claim 1, wherein the heat dissipation device has a front portion and a back portion, the front portion has an extending structure to support the lighting apparatus, and the back portion has a plurality of holes for increasing the heat dissipation.

3. The lighting apparatus of claim 2, wherein the heat dissipation device has a wave structure for enlarging an area to conduct the heat passing out of the housing.

4. The lighting apparatus of claim 1, further comprising a base column, the base column is a detachable device connected to a surface, and the base column is connected to the housing for setting a distance between the surface and the housing as a heat protection structure.

5. The lighting apparatus of claim 4, wherein the base column has a bendable strip, and the bendable strip is connected to the base column and the housing for changing a lighting area of the lighting apparatus.

6. The lighting apparatus of claim 5, wherein the bendable strip is a plurality of segments being connected together, and an expandable portion is between each of the segments for the bendable strip to expand for adjusting a distance between the lighting apparatus and the lighting area.

7. The lighting apparatus of claim 1, wherein the light passing cover has a sliding track connected to the housing, and the sliding track permits the light passing cover to rotate for changing an irradiation pattern.

8. The lighting apparatus of claim 1, wherein the lighting apparatus further comprises a connecting structure, the connecting structure combines the housing and the light passing cover.

9. The lighting apparatus of claim 8, wherein the connecting structure has a first end and a second end, the first end has a protrusion portion connected to a holding portion of the housing, and the second end has an open notch connected to a head.

10. The lighting apparatus of claim 1, wherein the driving module has a wireless communicating device, the wireless communicating device receives a signal from a command given from an external remote device and conducts the signal to an external output system, the external output system revises the signal to an indicated sign and sends the indicated sign back to the wireless communicating device, and the wireless communicating device sends the indicated sign to command the lighting apparatus corresponding to the external remote device.

11. The lighting apparatus of claim 10, wherein the external remote device has a determined group with multiple applications, and the multiple applications provides functional services of the lighting apparatus.

12. The lighting apparatus of claim 11, wherein the driving module has a memorizing device for a determined action command of a user.

13. The lighting apparatus of claim 12, wherein the memorizing device has a tracking system tracking a light emitting period of an area through a sensor for changing an illumination of the lighting apparatus.

14. The lighting apparatus of claim 12, wherein the memorizing device has a sound receiving system receiving a voice from the user, the sound receiving system senses an emotion in the voice and gives a command to the lighting apparatus according to the emotion.

15. The lighting apparatus of claim 1, wherein the light source assemblage has a first set with a first color temperature light source and a second set with a second color temperature light source, the first set and the second set share a common driving current, the first set has a first segment and a second segment and the second set has a first segment and a second segment, the common driving current is passed to the first set and the second set in a plurality of time slots, at least one of the first segment and the second segment of the first set and at least one of the first segment and the second segment of the second set emits the light in every time slot.

16. The lighting apparatus of claim 1, wherein the housing has a light passing hive system for a light to diffuse along an installed surface, and the light passing hive system has a plurality of notches for the light to pass out.

17. The lighting apparatus of claim 16, wherein the light passing hive system has an inner portion and a side portion, the inner portion contains a corner for the light to spread out and the side portion has a reflective optic to transmit the light to an extensive angle.

* * * * *